US009079300B2

(12) United States Patent
Poindexter et al.

(10) Patent No.: US 9,079,300 B2
(45) Date of Patent: Jul. 14, 2015

(54) HAMMER WRENCH SAFETY DEVICE

(71) Applicant: Hammer Tight, Inc., Cotopaxi, CO (US)

(72) Inventors: Phillip B. Poindexter, Cotopaxi, CO (US); Bruce A. Smith, Cotopaxi, CO (US)

(73) Assignee: Hammer Tight, Inc.

( * ) Notice: Subject to any disclaimer, the term of this patent is extended or adjusted under 35 U.S.C. 154(b) by 223 days.

(21) Appl. No.: 13/901,095

(22) Filed: May 23, 2013

(65) Prior Publication Data

US 2013/0312576 A1 Nov. 28, 2013

Related U.S. Application Data

(60) Provisional application No. 61/688,951, filed on May 25, 2012.

(51) Int. Cl.
*B25B 23/00* (2006.01)
*B25B 19/00* (2006.01)

(52) U.S. Cl.
CPC ..... *B25B 23/00* (2013.01); *B25B 19/00* (2013.01)

(58) Field of Classification Search
CPC .... B25B 23/00; B25B 23/02; B25B 23/0085; B25B 19/00; B25B 13/48
See application file for complete search history.

(56) References Cited

U.S. PATENT DOCUMENTS

| | | | | |
|---|---|---|---|---|
| 1,390,071 | A * | 9/1921 | Wetzstein | 81/9.24 |
| 1,684,215 | A | 3/1925 | Connell | |
| 2,704,474 | A * | 3/1955 | South | 81/55 |
| 3,003,378 | A * | 10/1961 | Hotchner | 81/475 |
| 4,864,902 | A * | 9/1989 | Doorley | 81/466 |
| 2012/0093609 | A1 * | 4/2012 | Trifilio et al. | 411/103 |

* cited by examiner

*Primary Examiner* — David B Thomas
(74) *Attorney, Agent, or Firm* — Trenner Law Firm; Mark D. Trenner

(57) ABSTRACT

A hammer wrench securing apparatus includes a collar having an elongate portion with a length and a first external perimeter as well as a base portion with a second external perimeter greater than the first external perimeter. A washer has a first internal perimeter extending around the elongate portion distal from the base portion and a spring extends around the elongate portion of the threaded collar between the base portion and the washer. In a method for removing at least one degree of freedom of a wrench, an internally threaded member is applied to an externally threaded member, a tool end of a wrench is applied to the internally threaded member, a threaded sleeve is applied to the externally threaded member adjacent to the internally threaded member and a washer is biased towards the tool end of the wrench.

20 Claims, 7 Drawing Sheets

HAMMER WRENCH SAFETY DEVICE

PRIORITY CLAIM

This application claims the benefit of U.S. Provisional Patent Application No. 61/688,951 titled "Hammer wrench safety device" of Poindexter, et al., filed on May 25, 2012, and incorporated by reference for all that it discloses as though fully set forth herein.

BACKGROUND

In some industries, such as the oil industry, very large threaded fasteners such as nuts and bolts are used to join components to provide a tight seal between mating surfaces. To tighten or loosen such large fasteners striking wrenches or hammer wrenches are used in combination with a hammer to apply the forces necessary to rotate the fasteners. Because striking a wrench engaged to a fastener with a hammer may cause the wrench to become disengaged from the fastener, it is typical to have one person hold tension on a rope tied around the handle of the hammer wrench while another person strikes the wrench with a hammer to tighten the nut. This is inefficient, can result in damage to the equipment, and is unsafe.

DETAILED DESCRIPTION

According to practice, one person may hold tension on a rope tied around the handle of the hammer wrench, while another person strikes the wrench with a hammer to tighten a nut on a work piece. However, it is possible for the hammer wrench to be propelled toward one of these people and/or bystander (e.g., flying through the space around the work piece). Therefore, this practice can be unsafe.

A safety device is disclosed herein which greatly reduces this hazard by eliminating the need for a person to hold tension on a rope tied to the hammer wrench handle. The safety device reduces or altogether prevents disengagement of the hammer wrench from the work piece. Preventing this disengagement may be particularly useful when the work piece is in a difficult to reach position (e.g., underneath another object). The device provides a much safer and still effective way to hold the wrench onto the nut while striking the hammer wrench (e.g., with a large hammer). As such, the occurrence of serious injuries may be greatly reduced or even altogether avoided.

Before continuing, it is noted that as used herein, the terms "includes" and "including" mean, but is not limited to, "includes" or "including" and "includes at least" or "including at least." The term "based on" means "based on" and "based at least in part on."

Figure 1:
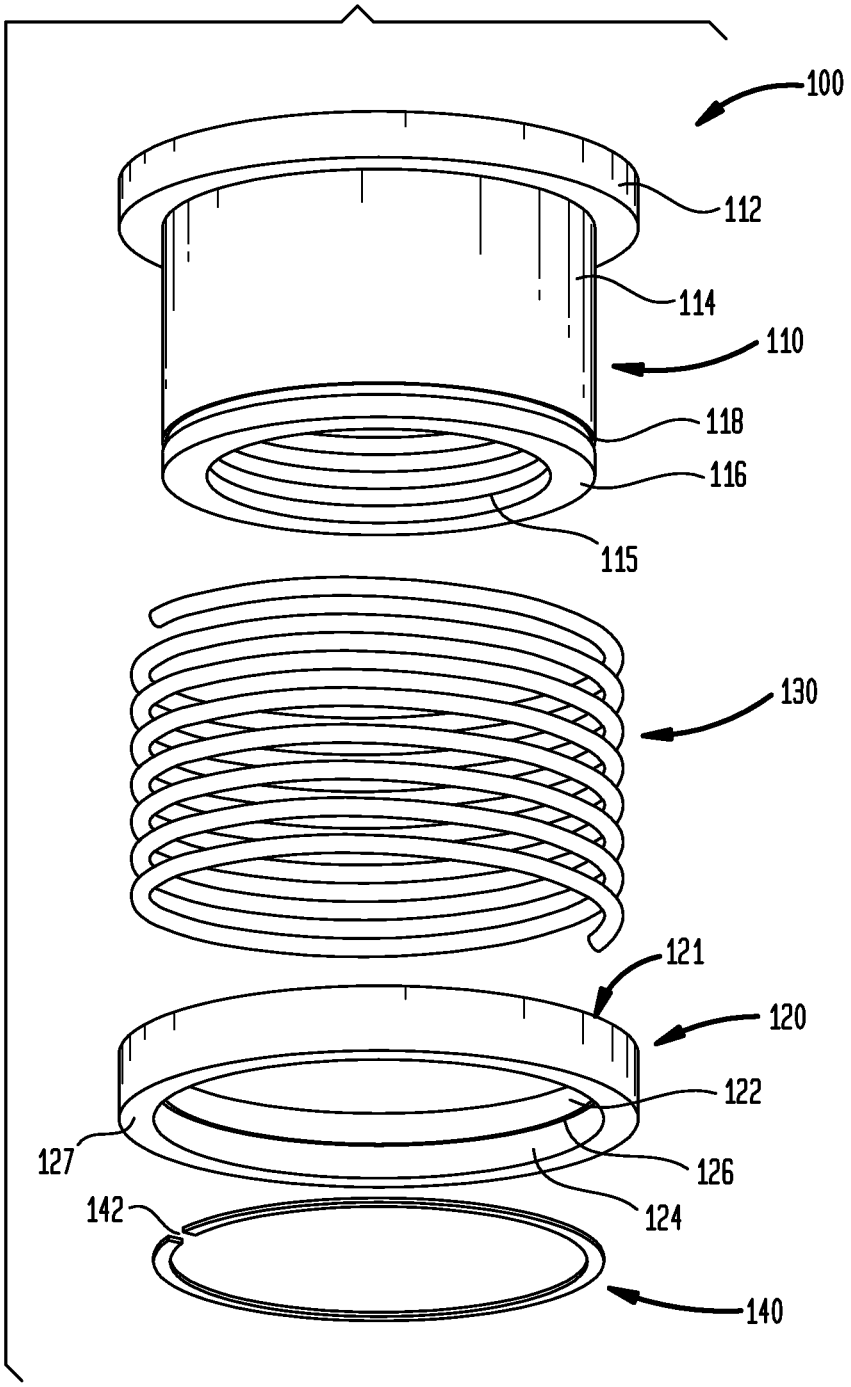
FIG. 1 illustrates an exploded side elevation view of an example hammer wrench safety device.

FIG. 1 illustrates an exploded side elevation view of an example hammer wrench safety device. As illustrated by way of example, a hammer wrench safety device 100 includes an external thread engagement means 110, a pressuring means 120, a biasing means 130 and a locking means 140.

In an example, an external thread engagement means, which may be provided as a sleeve or collar 110, includes an elongate portion 114 having a length and a first external perimeter as well as a supporting means or base portion 112 in the form of a flange having a second external perimeter greater than the first external perimeter. Although shown having a smooth surface around the side around the outer perimeter, the face of the side of base portion 112 may be ridged, knurled, or include another pattern to enhance the user's ability to grip the edge of base portion 112 (e.g., while wearing work gloves or with greasy hands).

The base portion 112 is configured to support an end of a biasing means 130. A threaded bore 115 is formed through the base 111 and elongate 114 portions of collar 110 to enable receipt of and engagement with an externally threaded member such as a bolt. The collar 110 may further comprise a receiving means provided in the form of a groove 118 formed in the first external perimeter distal from the base portion 112.

In an example, a pressuring means may be removably mounted on the collar 110, e.g., in the form of a washer or thrust washer 120 having a first internal perimeter 122 encircling or otherwise extending around elongate portion 114 at a position distal from base portion 112. A bottom surface 127 of the washer 120 provides a binding surface area to the top 410 of a wrench 400 used with safety device 100. A retaining means of washer 120 may be provided in the form of a shelf 126 formed between the first internal perimeter 122 and a second internal perimeter 124 greater than the washer first internal perimeter 122.

In an example, a shelf 126 may be configured to receive a locking means. First internal perimeter 122 extends from a top surface 121 of washer 120 to a position intermediate to top surface 121 and a bottom surface 127 of washer 120 while the washer second internal perimeter 124 extends from the intermediate position to bottom surface 127. As such, shelf 126 is provided in a location intermediate the top 121 and bottom 127 surfaces In an example, a biasing means 130 may be provided between collar 110 and washer 120, e.g., in the form of a spring 130 extending around elongate portion 114 of threaded collar 110 between base portion 112 and washer top surface 121. A spring 130 provides a downward pressure to top surface 121 of washer 120 thereby biasing washer 120 away from base portion 112. The spring 130 may take any of a variety of spring forms including but not limited to a coiled spring.

In an example, the washer 120 may further comprise a second receiving means which may be provided in the form of a closed groove 128 in the top surface just outside the first internal perimeter. The closed groove 128 may be configured to accommodate a portion of the biasing means or spring 130.

In an example, a locking means may be provided as a snap ring 140 within the groove or receiving means 118. The locking means may be configured to lock washer 120 on the collar 110 with the washer 120 surrounding snap ring 140, thereby reducing or altogether preventing washer 120 from unwanted displacement (e.g., distally from distal end 116 of elongate portion 114).

If disassembly of safety device 100 is desired, the snap ring 140 may be radially expanded such that gap 142 and the ring diameter are sufficiently increased to enable snap ring 140 to be removed from groove 118, and the washer 120 may be removed from the elongate portion 114.

Figure 2:
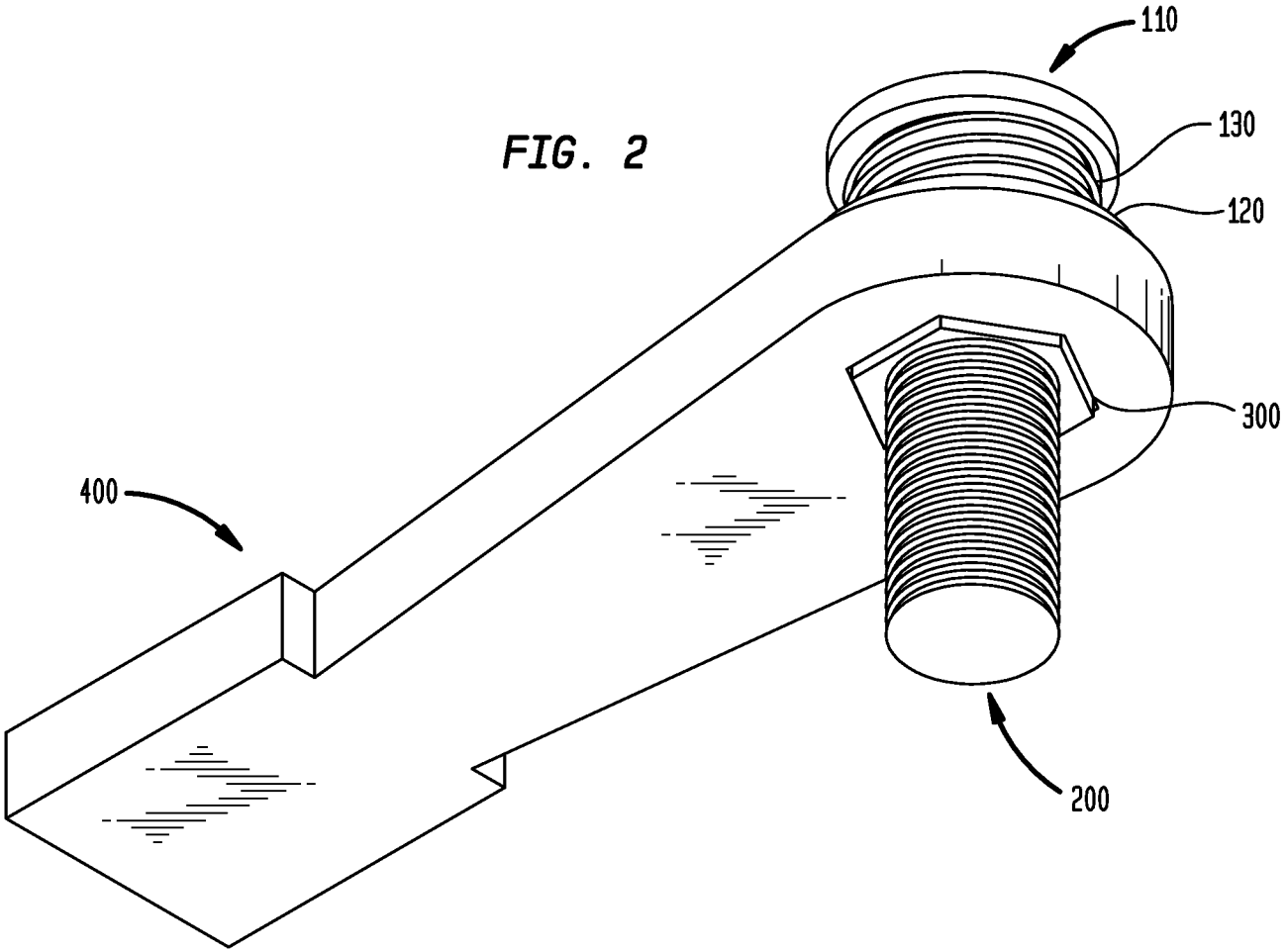
FIG. 2 illustrates a perspective view of the example hammer wrench safety device shown in FIG. 1, as it may be engaged with a threaded fastener and a hammer wrench.
Figure 3:
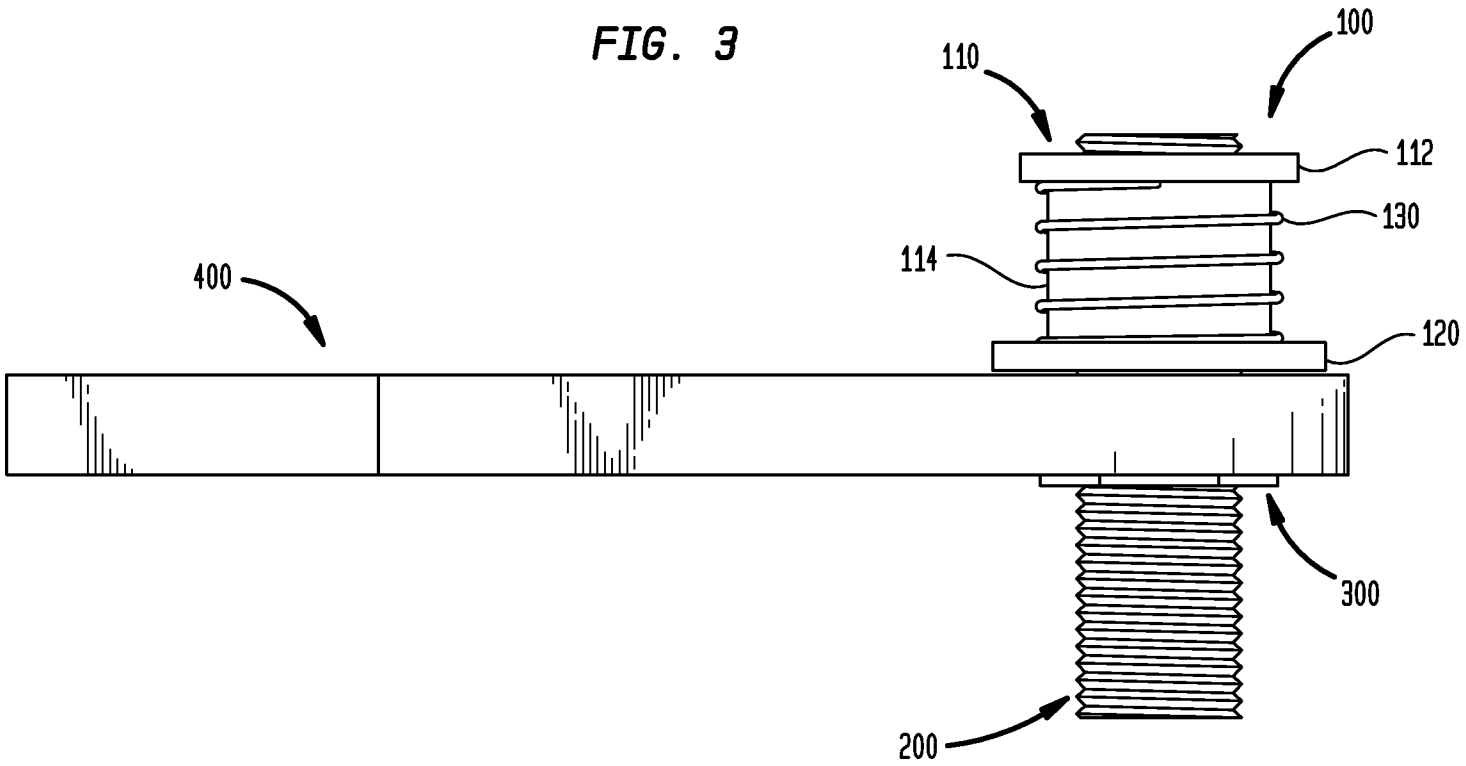
FIG. 3 illustrates a side view of the example hammer wrench safety device shown in FIG. 1, as it may be engaged with a threaded fastener and a hammer wrench.

With device 100 fully assembled, the washer 120 and spring 130 are capable of rotation relative to collar 110. FIG. 2 illustrates a perspective view of the example hammer wrench safety device shown in FIG. 1, as it may be engaged with a threaded fastener and a hammer wrench. FIG. 3 illustrates a side view of the example hammer wrench safety device shown in FIG. 1, as it may be engaged with a threaded fastener and a hammer wrench.

Before continuing, it should be noted that the examples described above are provided for purposes of illustration, and are not intended to be limiting. Other devices and/or device configurations may be utilized to carry out the operations described herein.

The safety device 100 may be used as part of a technique or in a method to remove at least one degree of freedom of a hammer wrench. In an example, the safety device 100 is assembled by application of washer 120 to collar 110 by providing a snap ring 140 within a groove 118 formed in an external surface of collar 110. Washer 120 is biased towards or against the tool end of the wrench 400 by providing spring 130 between base or flange 112 and biasing washer 120.

With a nut or other internally threaded member 300 applied to a bolt externally threaded member 200, a tool end of a wrench 400 is applied to nut 300. Safety device 100 may then coupled to bolt 200 by screwing collar 110 and threads 115 clockwise onto exposed threads of bolt 200 protruding beyond nut 300. Collar 110 is screwed to a position adjacent to nut 300 until washer 120 is tight against nut 300 and wrench face 410 (see, e.g., FIGS. 2 and 3). In this configuration, the tool end is supported by the washer 120 or compressed by washer 120 against another supporting surface. Device 100 can be used upside down where it is extremely difficult to hold a wrench on a nut while trying to strike the wrench to tighten the nut.

Figure 4B:
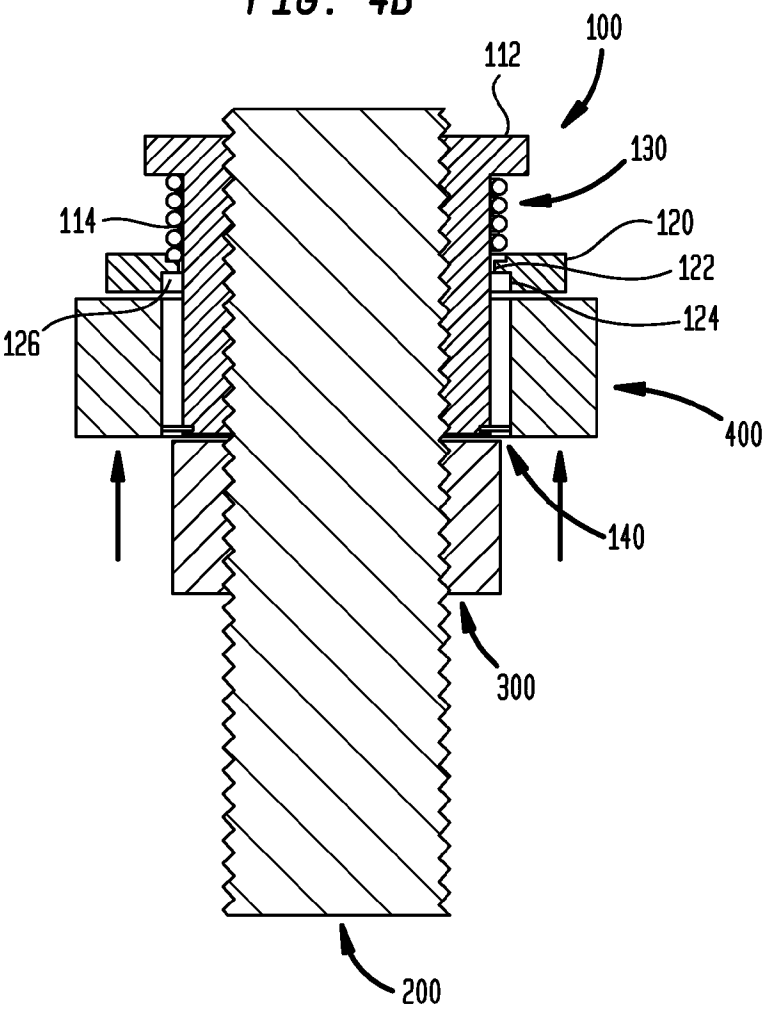
FIG. 4B illustrates a side section view of the example hammer wrench safety device shown in FIG. 1, shown in an compressed configuration and engaged with a threaded fastener and a hammer wrench.
Figure 4A:
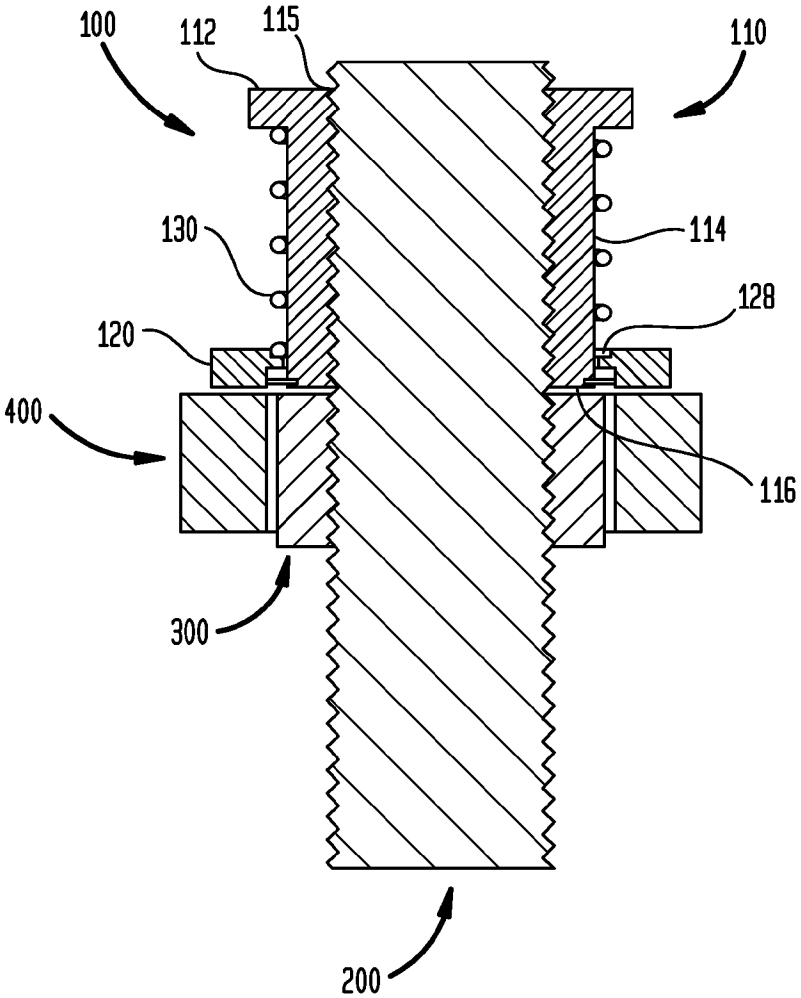
FIG. 4A illustrates a side section view of the example hammer wrench safety device shown in FIG. 1, shown in an expanded configuration and engaged with a threaded fastener and a hammer wrench.

FIG. 4A illustrates a side section view of the example hammer wrench safety device shown in FIG. 1, shown in an expanded configuration and engaged with a threaded fastener and a hammer wrench. FIG. 4B illustrates a side section view of the example hammer wrench safety device shown in FIG. 1, shown in an compressed configuration and engaged with a threaded fastener and a hammer wrench. The example hammer wrench safety device may be engaged to a bolt or other externally threaded member 200 by internally threaded bore 115 and contacting a hammer wrench 400.

Figure 5A:
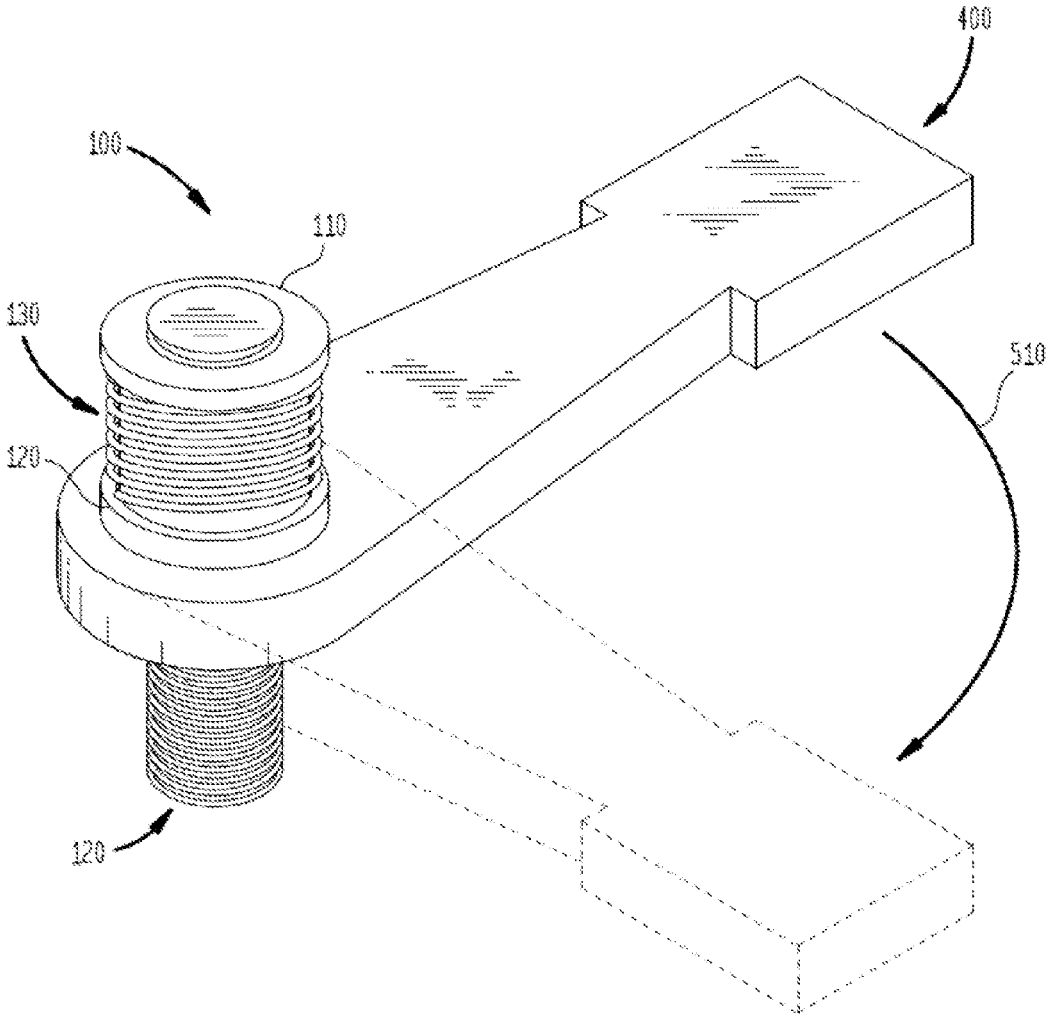
FIG. 5A illustrates a perspective view of the example hammer wrench safety device shown in FIG. 1, as it may be engaged with a threaded fastener and a hammer wrench moving in a clockwise orientation to tighten a nut.
Figure 5B:
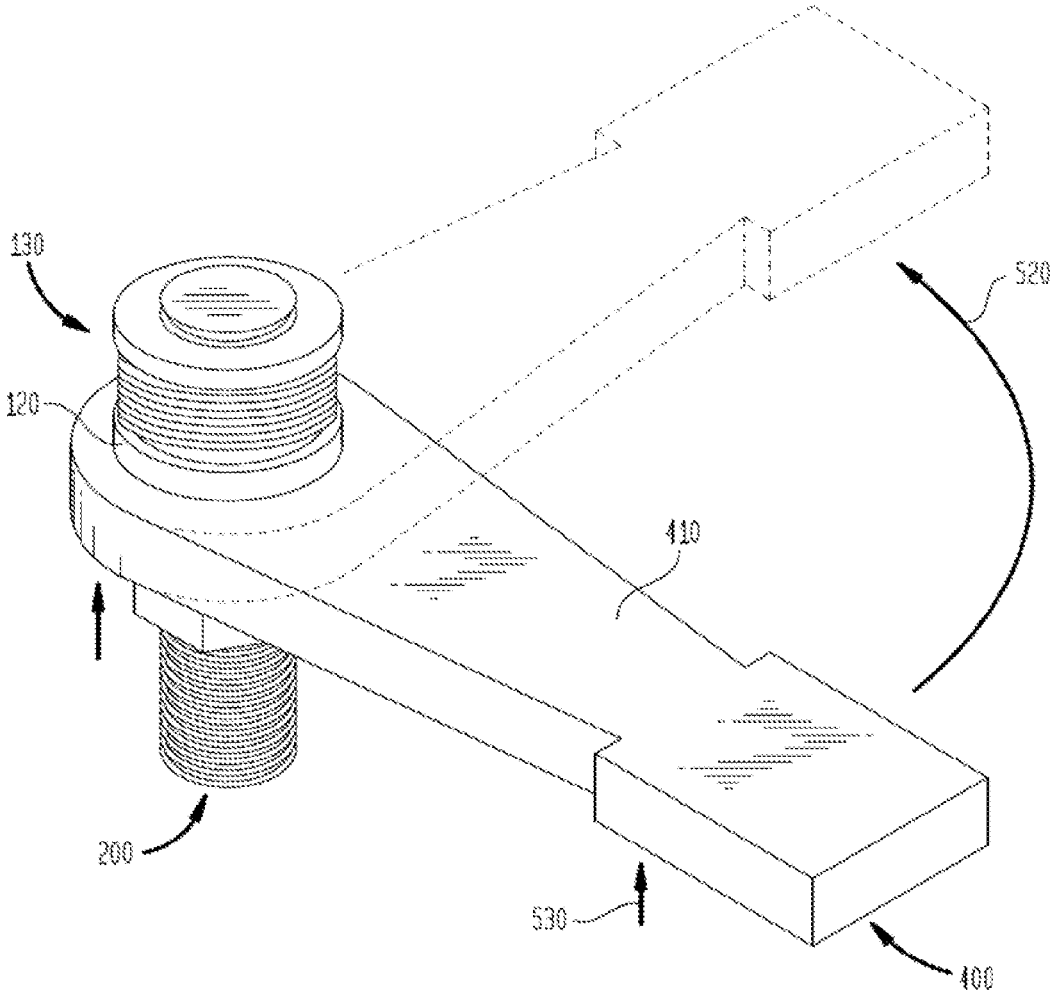
FIG. 5B illustrates a perspective view of the example hammer wrench safety device shown in FIG. 1, as it may be engaged with a threaded fastener and a hammer wrench moving upwards, and then moved in a counterclockwise orientation to transition from a first grip to a second grip on a nut.

FIG. 5A illustrates a perspective view of the example hammer wrench safety device shown in FIG. 1, as it may be engaged with a threaded fastener and a hammer wrench 400 moving in a clockwise orientation to tighten a nut. FIG. 5B illustrates a perspective view of the example hammer wrench safety device shown in FIG. 1, as it may be engaged with a threaded fastener and a hammer wrench 400 moving upwards, and then moved in a counterclockwise orientation to transition from a first grip to a second grip on a nut. It is noted that the spring is compressed in FIG. 5B (when compared to FIG. 5A).

The hammer wrench 400 is shown in FIG. 5A by way of illustration in gripping engagement with nut 300, and can be moved in a clockwise orientation, as indicated by arrow 510, to tighten nut 300. Clockwise movement may be enacted by applying a pressure or force to the side of handle element of the hammer wrench 400, e.g., by striking the side face of the hammer wrench 400 with an object such as a hammer (not illustrated).

In some circumstances, hammer wrench 400 may be prevented from 360 degrees of rotation due to, for example, an obstruction. Accordingly, rotation of the hammer wrench 400 may be discontinued at any of a variety of angles.

If further tightening of nut 300 is desired, hammer wrench 400 may be repositioned relative to nut 300. Referring to FIG. 5B, hammer wrench 400 may be lifted along the rotational axis in a direction indicated by arrows 530 such that it disengages from nut 300. In this position, upper surface 410 of hammer wrench 400 applies a force to bottom surface 127 of washer 120 to compress spring 130 and move washer 120 along collar 110 towards base of flange 112 (FIG. 4B). Hammer wrench 400 may then be rotated in a counterclockwise orientation indicated by arrow 520 for repositioning relative to nut 300.

In some circumstances to enable movement of hammer wrench in the direction of arrows 530, it may be desirable to adjust the position of safety device 100 along the length of threaded member 200 in the direction illustrated by arrow 510 or 520. With hammer wrench 400 rotated to a new angle relative to nut 300, application of a force on hammer wrench 400 in the direction of arrows 530 may be discontinued such that spring 130 forces hammer wrench 400 back into engagement with nut 300 (see, e.g., FIG. 4A). With hammer wrench 400 re-engaged with nut 300, hammer wrench 400 may again be rotated in a clockwise orientation to turn nut 300. Safety device 100 may be removed by rotating collar 110 counterclockwise to be unscrewed.

It is noted that the operations shown and described herein are provided to illustrate example implementations. It is noted that the operations are not limited to the ordering shown. Still other operations may also be implemented.

In an example, threading of fasteners with which safety device 100 and hammer wrench 400 are used may be formed such that counterclockwise rotation affects a tightening and clockwise rotation affects a loosening. In such examples, the directions of arrows 510 and 520 are reversed (see, e.g., FIGS. 5A-B).

Figure 6A:
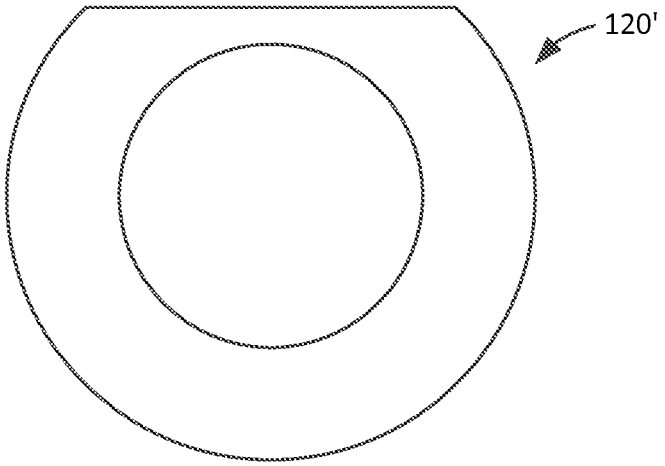
FIG. 6A illustrates a top plan view of another example move washer.
Figure 6B:
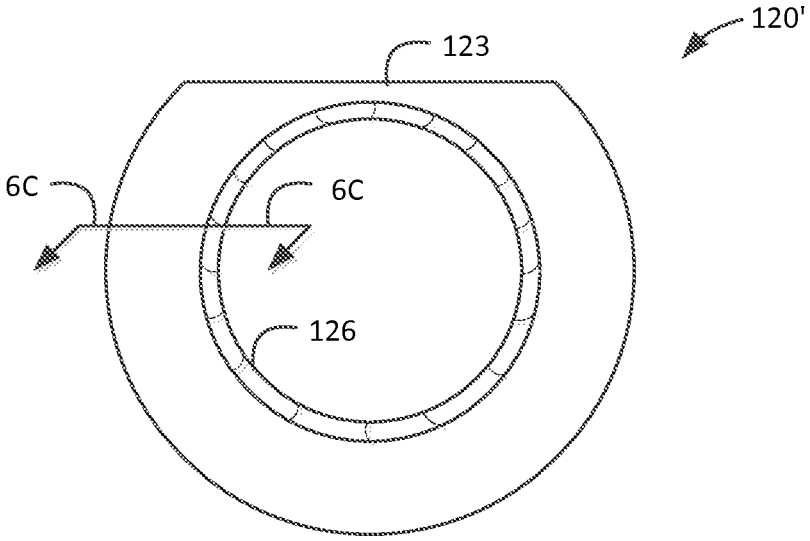
FIG. 6B illustrates a bottom plan view of the example move washer shown in FIG. 6A.

FIG. 6A illustrates a top plan view of another example thrust (or move) washer 120'. FIG. 6B illustrates a bottom plan view of the example move washer 120' shown in FIG. 6A. The move washer 120' in this example has a flat edge 123. The flat edge 123 may be provided, e.g., when an offset wrench is used. For example, an offset wrench may include the portion which fits over a nut in one axis, and then the handle bends upward (e.g., at 90 degrees or otherwise) and then the handle extends out in a second, albeit generally parallel axis, thereby raising the handle portion over adjacent nuts or other components so that the handle can be rotated above these adjacent nuts or other components. The flat edge

123 on the move washer 120' enables use with such an offset wrench (e.g., by accommodating the 90 degree bend.

Figure 6C:
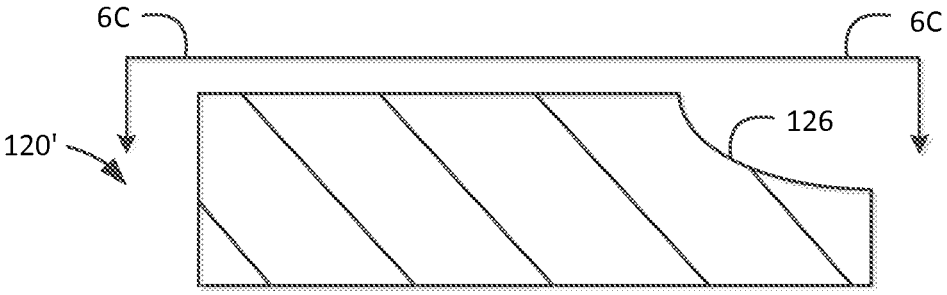
FIG. 6C is a partial cross-sectional view taken at section indicated by arrows 6C-6C in FIG. 6B, showing a machined relief.

The move washer 120' in this example is also shown having a machined relief 126' (see the bottom view in FIG. 6B), for example to receive the snap ring 140 therein (similar to the shelf 126 in FIG. 1) FIG. 6C is a partial cross-sectional view taken at section indicated by arrows 6C-6C in FIG. 6B, showing the machined relief. Although illustrated having a curved radius, the relief can be any shape.

In another example, safety device 100 may be engaged with an externally threaded fastener in a positioned below a hammer wrench. In such examples, hammer wrench 400 is pushed downward in a direction opposite arrows 530 to disengage from nut 300 and allow the above-described repositioning.

In example uses, safety device 100 may be positioned to supply a force to a hammer wrench engaged to the head of a screw rather than to a nut.

It is noted that safety device 100 may be used in a variety of industries, and is not limited to use in the oil industry. For example, safety device 100 may be used in the heavy equipment field, wherein large wrenches often have to be secured by large forces applied to tighten and remove large nuts.

It is noted that the examples shown and described are provided for purposes of illustration and are not intended to be limiting. Still other examples are also contemplated.

The invention claimed is:

1. A hammer wrench securing apparatus, comprising:

a collar including an elongate portion having a length and a first external perimeter, and a base portion having a second external perimeter greater than the first external perimeter;

a washer having a first internal perimeter extending around the elongate portion distal from the base portion; and a spring extending around the elongate portion of the collar between the base portion and the washer.

2. The hammer wrench securing apparatus as set forth in claim 1, wherein the collar further comprises a groove in the first external perimeter distal from the base portion.

3. The hammer wrench securing apparatus as set forth in claim 2, further comprising a snap ring within the groove.

4. The hammer wrench securing apparatus as set forth in claim 3, wherein the washer surrounds the snap ring.

5. The hammer wrench securing apparatus as set forth in claim 1, wherein the washer further comprises a second internal perimeter greater than the washer first internal perimeter such that a shelf is formed therebetween.

6. The hammer wrench securing apparatus as set forth in claim 5, wherein the washer includes a top surface and a bottom surface and the washer first internal perimeter extends from the top surface to a position intermediate to the top and bottom surfaces and the washer second internal perimeter extends from the intermediate position to the bottom surface.

7. The hammer wrench securing apparatus as set forth in claim 5, wherein the washer further comprises, in the top surface just outside the first internal perimeter, a groove configured to accommodate a portion of the spring.

8. The hammer wrench securing apparatus as set forth in claim 1, further comprising a threaded bore formed through the elongate and base portions of the collar.

9. The hammer wrench securing apparatus as set forth in claim 1, wherein the spring is a coiled spring.

10. A system for securing a striking wrench during use, comprising:

an external thread engagement means;

a pressuring means slidably positioned on the external thread engagement means; and a biasing means between the external thread engagement means and the pressuring means.

11. The system of claim 10, wherein the external thread engagement means further comprises a receiving means.

12. The system of claim 11, further comprising a locking means within the receiving means, the locking means configured to lock the pressuring means on the external thread engagement means.

13. The system of claim 10, wherein the external thread engagement means further comprises a supporting means configured to support an end of the biasing means.

14. The system of claim 10, wherein the pressuring means further comprises a second receiving means configured to receive an end of the biasing means.

15. The system of claim 10, wherein the pressuring means further comprises a retaining means configured to receive the locking means.

16. A method for removing at least one degree of freedom of a wrench, comprising:

applying an internally threaded member to an externally threaded member;

applying a tool end of a wrench to the internally threaded member;

applying a threaded sleeve to the externally threaded member adjacent to the internally threaded member; and biasing a washer towards the tool end of the wrench.

17. The method of claim 16, further comprising locking the washer to the threaded sleeve.

18. The method of claim 16, wherein biasing the washer further comprises providing a spring between a flange of the externally threaded member and the biasing washer.

19. The method of claim 16, further comprising supporting the tool end with the washer.

20. The method of claim 19, wherein locking the washer further comprises providing a snap ring within a groove formed in an external surface of the threaded sleeve.

* * * * *